US008371463B2

(12) United States Patent
Beecroft

(10) Patent No.: US 8,371,463 B2
(45) Date of Patent: Feb. 12, 2013

(54) CHILD-RESISTANT CANISTER

(75) Inventor: W. Gordon Beecroft, Leola, PA (US)

(73) Assignee: Berry Plastics Corporation, Evansville, IN (US)

( * ) Notice: Subject to any disclaimer, the term of this patent is extended or adjusted under 35 U.S.C. 154(b) by 671 days.

(21) Appl. No.: 12/507,557

(22) Filed: Jul. 22, 2009

(65) Prior Publication Data

US 2010/0025355 A1 Feb. 4, 2010

Related U.S. Application Data

(60) Provisional application No. 61/083,419, filed on Jul. 24, 2008.

(51) Int. Cl.
*B65D 55/02* (2006.01)
*B65D 41/06* (2006.01)

(52) U.S. Cl. ..... 215/216; 215/232; 215/332

(58) Field of Classification Search ..... 215/216, 215/222, 332

See application file for complete search history.

(56) References Cited

U.S. PATENT DOCUMENTS

| | | | | | |
|---|---|---|---|---|---|
| 3,072,276 | A | * | 1/1963 | Nichols | 215/222 |
| 3,828,957 | A | * | 8/1974 | Marchant | 215/223 |
| 3,888,375 | A | | 6/1975 | Gerk | |
| 3,917,097 | A | | 11/1975 | Uhlig | |
| 3,941,268 | A | | 3/1976 | Owens et al. | |
| 3,984,021 | A | | 10/1976 | Uhlig | |
| 3,989,152 | A | | 11/1976 | Julian | |
| 3,993,208 | A | | 11/1976 | Ostrowsky | |
| 4,149,646 | A | | 4/1979 | Julian | |
| 4,373,641 | A | * | 2/1983 | Banich et al. | 215/331 |
| 4,752,013 | A | | 6/1988 | Miller et al. | |
| 4,752,014 | A | | 6/1988 | House et al. | |
| 4,948,002 | A | | 8/1990 | Thornock et al. | |
| 5,038,454 | A | | 8/1991 | Thornock et al. | |
| D330,677 | S | | 11/1992 | Thornock et al. | |
| 5,230,433 | A | | 7/1993 | Hamilton et al. | |
| 5,383,564 | A | | 1/1995 | Hamilton et al. | |
| 5,413,233 | A | | 5/1995 | Hall | |
| 5,449,077 | A | | 9/1995 | Seidler | |
| 5,449,078 | A | * | 9/1995 | Akers | 215/222 |
| 5,460,281 | A | | 10/1995 | Rapchak et al. | |
| 5,462,182 | A | | 10/1995 | Opresco | |
| 5,671,853 | A | | 9/1997 | Herr | |
| 5,687,863 | A | * | 11/1997 | Kusz | 215/216 |
| 5,927,526 | A | | 7/1999 | Herr | |
| 6,036,036 | A | * | 3/2000 | Bilani et al. | 215/216 |
| 6,112,921 | A | * | 9/2000 | Robinson | 215/216 |
| 6,378,713 | B2 | * | 4/2002 | Montgomery | 215/222 |
| 6,854,613 | B2 | * | 2/2005 | Biesecker et al. | 215/219 |
| 2007/0194047 | A1 | | 8/2007 | Tauber et al. | |

FOREIGN PATENT DOCUMENTS

| | | |
|---|---|---|
| CA | 2001079 | 4/1990 |

* cited by examiner

*Primary Examiner* — Anthony Stashick
*Assistant Examiner* — James N Smalley
(74) *Attorney, Agent, or Firm* — Barnes & Thornburg LLP

(57) ABSTRACT

A child-resistant canister includes a container and a closure configured to mount on the container to close an opening into an interior region formed in the container. The closure includes a lid and a lid anchor coupled to the lid. The lid anchor is configured to mate with a closure retainer included in the container to retain the closure in a mounted position on the container.

24 Claims, 5 Drawing Sheets

FIG. 8
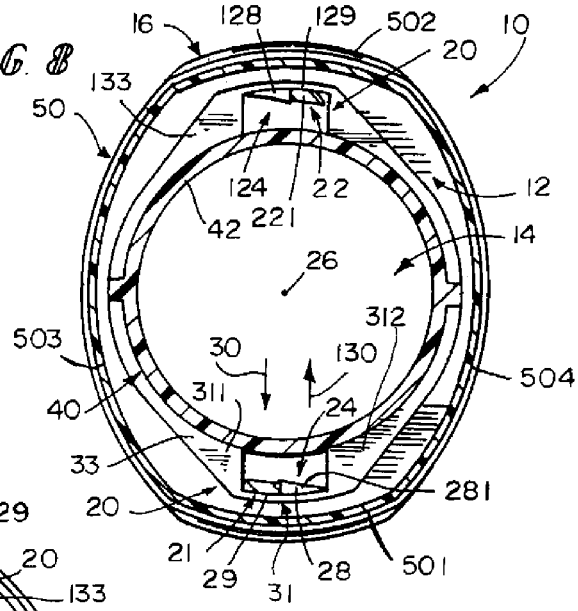
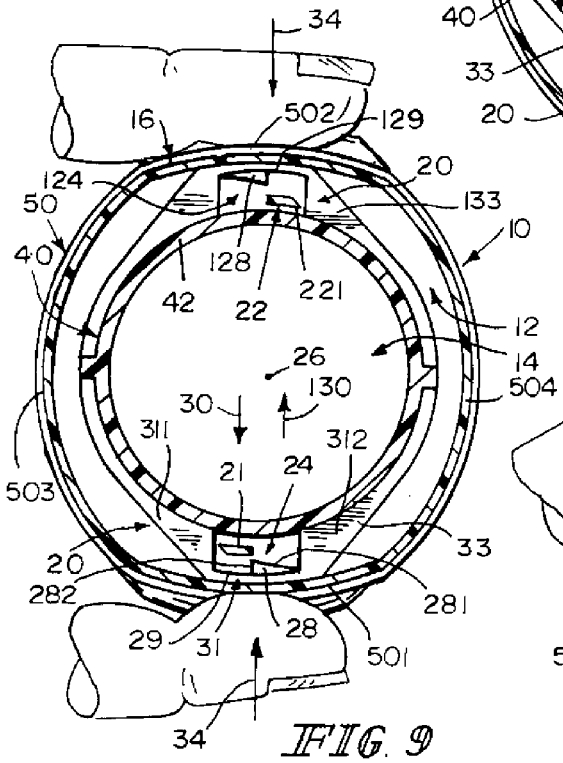
FIG. 9
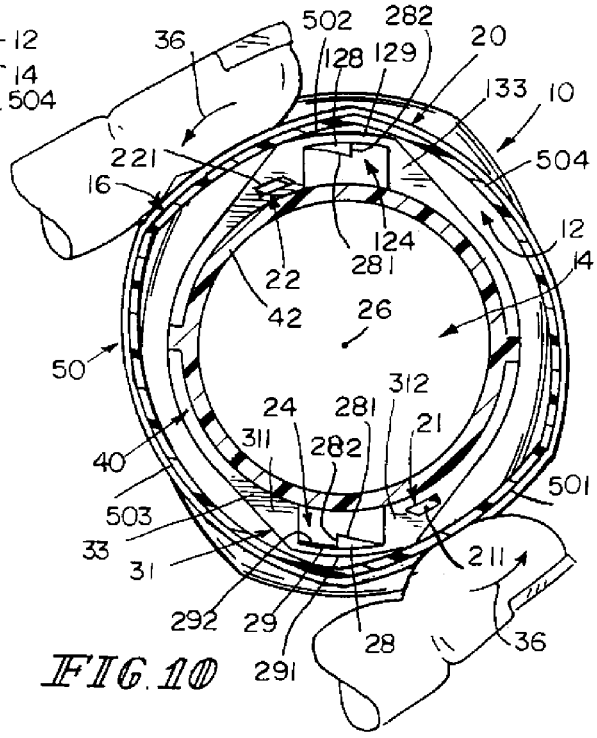
FIG. 10

CHILD-RESISTANT CANISTER

This application claims priority under 35 U.S.C. §119(e) to U.S. Provisional Application Ser. No. 61/083,419, filed Jul. 24, 2008, which is expressly incorporated by reference herein.

BACKGROUND

The present disclosure relates to a canister, and particularly to a canister including a container and a removable closure. More particularly, the present disclosure relates to a child-resistant canister.

SUMMARY

According to the present disclosure, a child-resistant canister includes a container and a closure configured to mount on the container to close an opening into an interior region formed in the container. The closure includes a lid and a lid anchor coupled to the lid. The lid anchor is configured to mate with a closure retainer included in the container to retain the closure in a mounted position on the container.

In illustrative embodiments, the child-resistant canister further includes a closure-release control mechanism. The closure-release control mechanism includes a first lock tab coupled to the lid and a companion first tab controller coupled to the container. The first tab controller is configured to block radially outward movement of the first lock tab away from the axis of rotation of the closure when the closure is mounted on the container to cause the first lock tab to be located in a locked position. The first tab controller minimizes the chance of unauthorized removal of the closure from the container by blocking movement of the first lock tab in an outward direction.

In illustrative embodiments, the first tab controller is formed to include a lock-tab receiver channel sized and located to receive the first lock tab therein when the closure is mounted on the container. The first tab controller also includes a stationary blocker and a tab-motion limiter strip. The tab-motion limiter strip is arranged to retain the first lock tab in the locked position by blocking movement of the first lock tab in a radially outward direction to disengage the stationary tab blocker when the closure is mounted on the container.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 5 shows downward movement of the first lock tab toward the stationary tab blocker coupled to a horizontal tab-blocker support platform included in the closure-release control mechanism as the closure is rotated in a clockwise direction about a vertical axis of rotation toward an installed position on the container;

FIG. 6 shows further downward movement of the first lock tab into a lock-tab receiver channel formed in the tab-blocker support platform coupled to the container;

FIG. 7 shows deployment of the first child-resistant lock tab in the lock-tab receiver channel to cause an end wall of the first lock tab to mate with a tab stop included in the triangle-shaped tab blocker and a relatively longer outer side wall of the lock tab to mate with a tab-motion limiter strip included in the tab-blocker support platform and configured to provide means for blocking movement of the first lock tab in a radially outward direction away from the axis of rotation of the closure while the closure is installed on the container and the first lock tab is arranged to lie in confronting relation to the tab stop included in the triangle-shaped tab blocker;

FIGS. 8-10 show, in sequence, movement of the first lock tab coupled to the closure relative to the companion triangle-shaped tab blocker coupled to the container during removal of the closure from the container;

FIG. 8 is a sectional view taken along line 8-8 of FIG. 7 showing mating engagement of an outer side wall of each of the first and second lock tabs coupled to the closure with a companion tab-motion limiter strip included in the tab-blocker support platform coupled to the container to block radially outward movement of the lock tabs away from the axis of rotation of the closure while the closure is mounted in an installed position on the container;

FIG. 9 is a sectional view similar to FIG. 8 showing a user applying squeezing forces (represented by opposing arrows) to the two bowed tab-mover walls included in the lid to move each of the first and second lock tabs radially inwardly to cause each of those lock tabs to separate from a companion tab-motion limiter strip and a tab stop of a companion triangle-shaped tab-motion blocker to free the closure so it can be rotated in a counterclockwise closure-removal direction relative to the container;

FIG. 10 is a sectional view similar to FIGS. 8 and 9 showing counterclockwise rotation of the closure relative to the container in the closure-removal direction.

DETAILED DESCRIPTION

Figures 1, 2:
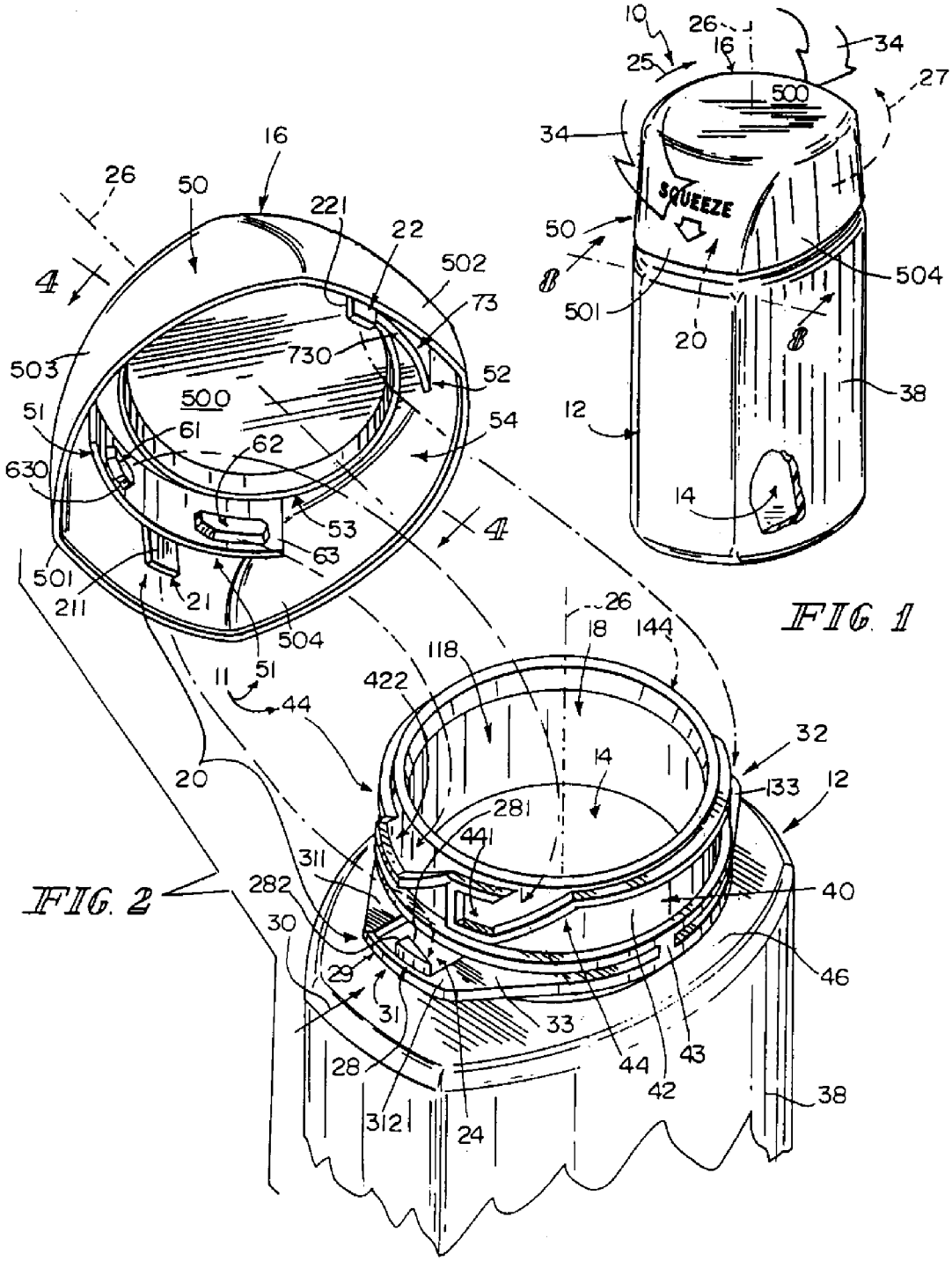
FIG. 1 is a perspective view of a child-resistant canister in accordance with the present disclosure showing a closure mounted on an underlying container and suggesting that an adult user can apply a squeezing pressure (represented by two double arrows) to front and rear sides of the closure to disable a child-resistant closure-release control mechanism provided in the canister so that the closure is free to rotate in a counterclockwise closure-removal direction (represented by a phantom arrow) from the closed position shown in FIGS. 1, 7, and 8 toward an opened position in a manner suggested, for example, in FIGS. 8-10.
FIG. 2 is an enlarged perspective assembly view of the canister of FIG. 1 showing the closure before it is installed on the container of FIG. 1 and showing one of the upwardly extending (triangle-shaped) tab blockers included in the closure-release control mechanism and suggesting that one of the two long downwardly extending child-resistant lock tabs included in the closure-release control mechanism is arranged to mate with its companion triangle-shaped tab blocker and extend into a lock-tab receiver channel formed in the closure-release control mechanism when the closure is mounted on the container in the manner suggested in FIGS. 5-7 to lock the closure to the container so that it cannot be removed easily by a child.
Figure 7:
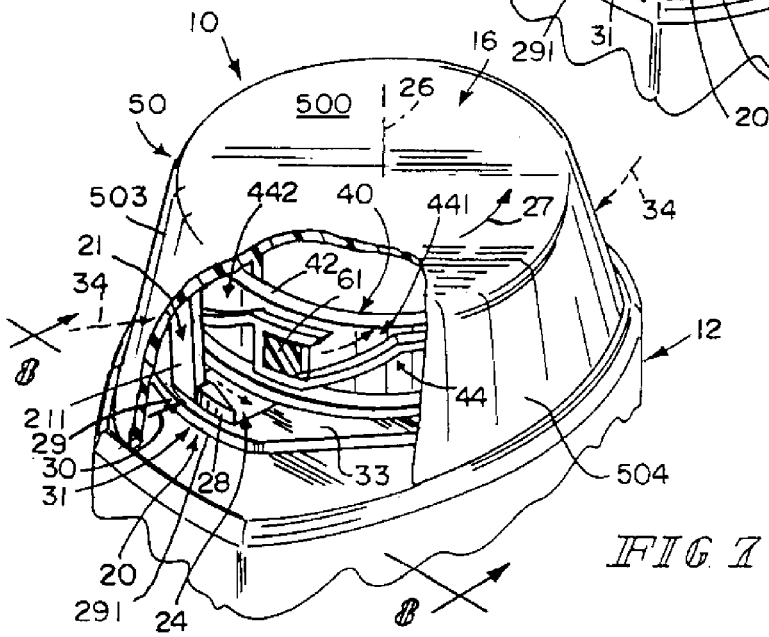

A child-resistant canister 10 includes a container 12 formed to include a product-receiving chamber 14 and a removable closure 16 configured to mount on top of container 12 and cover open mouth 18 of container 12 as suggested in FIGS. 1, 2, and 7. Canister 10 also includes a child-resistant closure-release control mechanism 20 comprising a first lock tab 21 coupled to closure 16 and a companion first tab controller 31 coupled to container 12 and configured to mate with first lock tab 21 as suggested in FIGS. 2 and 7. A container 212 in accordance with a second embodiment of the present disclosure and suitable for use with closure 16 is shown, for example, in FIG. 11.

Figure 5:
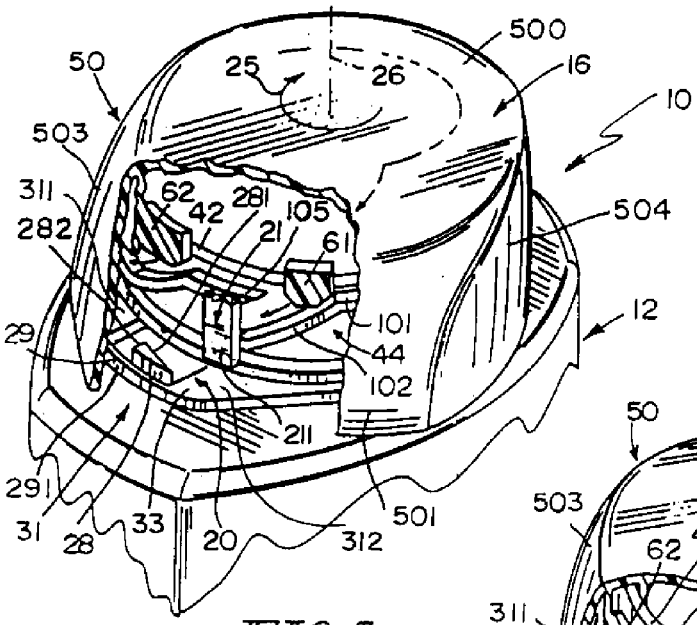
FIGS. 5-7 show, in sequence, movement of the first lock tab coupled to the closure relative to the companion triangle-shaped tab blocker coupled to the container during installation of the closure on the container.
Figure 6:
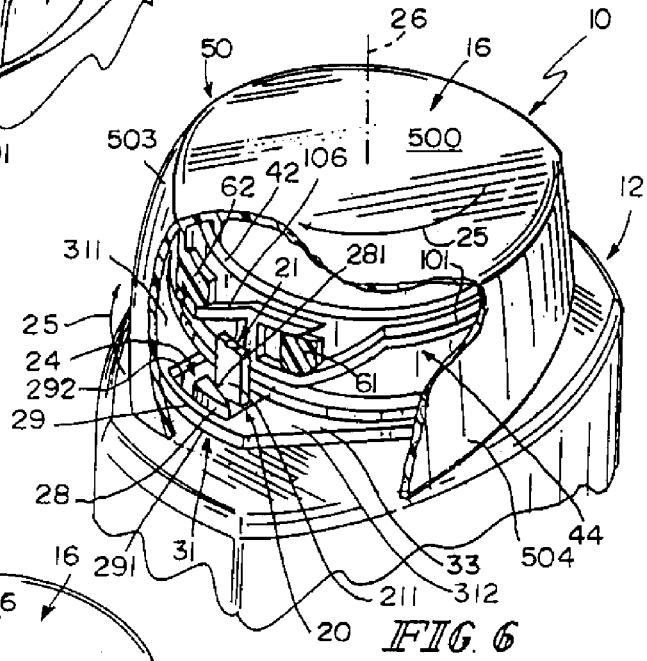

During installation of closure 16 on container 12, as suggested in FIGS. 5-7, first lock tab 21 of closure-release control mechanism 20 is moved into a lock-tab receiver channel 24 formed in first tab controller 31 of closure-release control mechanism 20 as closure 16 is rotated about axis of rotation 26 in a clockwise closure-installation direction 25 relative to the underlying container 12. A stationary tab blocker 28 included in first tab controller 31 is arranged normally to block rotation of closure 16 in a counterclockwise closure-removal direction 27 about axis 16 relative to container 12 as suggested in FIGS. 7 and 8.

A tab-motion limiter 29 included in first tab controller 31 of closure-release control mechanism 20 is arranged to lie alongside first lock tab 21 while first lock tab 21 extends into lock-tab receiver channel 24 to provide means for blocking movement of first lock tab 21 in a radially outward direction 30 away from axis 26 while closure 16 is installed on container 12 as suggested in FIGS. 7 and 8. Tab-motion limiter 29 takes the form of a strip of material in an illustrative embodiment as shown, for example, in FIG. 2. Tab-motion limiter strip 29 blocks inadvertent or purposeful movement of first lock tab 21 in radially outward direction 30 to disengage or separate from stationary tab blocker 28 during an unauthorized attempt by a child to remove closure 16 from container 12 and defeat the child-resistant character of closure 16.

Tab-motion limiter strip 29 does not obstruct movement of first lock tab 21 in a radially inward direction 130 toward axis 26 to separate first lock tab 21 from stationary tab blocker 28 when an adult applies squeezing forces 34 to closure 16 as suggested in FIGS. 1 and 9 to initiate removal of closure 16 from container 12. Once first lock tab 21 is separated from stationary tab blocker 28 as shown in FIG. 10, closure 16 is free to rotate about axis 26 in counterclockwise closure-removal direction 27 when the adult applies twisting forces 36 (i.e., torque) to closure 16 in an effort to remove closure 16 from container 12.

Container 12 includes a body 38 and a filler neck 40 coupled to body 38 as shown, for example, in FIG. 2. Filler neck 40 is formed to include a passageway 18 opening into product-receiving chamber 14 formed in body 38 as suggested in FIG. 2. Filler neck 40 includes a cylindrical rim 42 coupled to body 38 and a closure retainer 44 coupled to rim 42 and configured to mate with closure 16 to retain closure 16 in an installed position on container 12 as suggested in FIG. 7.

Closure retainer 44 is coupled to exterior surface 43 of rim 42 in the illustrated embodiment. Closure retainer 44 comprises a series of rail sections as shown in an illustrative embodiment. Closure retainer 44 and rim 42 cooperate to form a monolithic element in the illustrated embodiment.

First tab controller 31 is coupled to an exterior surface 43 of rim 42 of filler neck 40 of container 12 in an illustrative embodiment of the present disclosure as suggested in FIGS. 2 and 5-7. First tab controller 31 is positioned to lie below closure retainer 44 on rim 42 and above a top wall 46 of body 38 of container 12 as shown best in FIG. 2.

First tab controller 31 includes stationary tab blocker 28 and tab-motion limiter strip 29 as suggested in FIGS. 2, 5-7, and 8-10. In an illustrative embodiment, first tab controller 31 includes a tab-blocker support platform 33 coupled to rim 42 of filler neck 40 as shown in FIG. 2. Platform 33 includes tab-motion limiter strip 29 and has a generally trapezoidal shape in the illustrated embodiment and is formed to include a generally L-shaped lock-tab receiver channel 24 as suggested in FIGS. 2, 5-7, and 8-10. Tab blocker 28 is arranged to define an outer boundary of lock-tab receiver channel 24 in an illustrative embodiment as shown, for example, in FIG. 2.

Tab blocker 28 includes a cam ramp 281 and a stop face 282 as suggested in FIG. 2. Tab blocker 28 is coupled to tab-blocker support platform 33 to lie in a stationary position to intercept and/or mate with plate 211 of first lock tab 21 as first lock tab 21 moves in or near lock-tab receiver channel 24 as suggested in FIGS. 5-7 and in FIGS. 8-10. Cam ramp 281 is configured to provide means for contacting plate 211 as plate 211 moves downwardly into lock-tab receiver channel 24 during installation of closure 16 on container 12 and for yieldably biasing plate 211 in a radially inward direction until plate 211 clears tab blocker 28. Once cleared, the elastic plate 211 of first lock tab 21 snaps or moves in an opposite radially outward direction to assume a locked position shown, for example, in FIGS. 7 and 8 in which an edge of plate 211 lies in closely confronting relation to stop face 282 of tab blocker 28. Stop face 282 is configured to provide means for mating with the edge of plate 211 when closure 16 is mounted on container 12 to block movement of closure 16 about axis 26 relative to container 12 in counterclockwise closure-removal direction 27 as suggested in FIG. 7.

In an illustrative embodiment, first tab controller 31 is a monolithic element appended to rim 42 of filler neck 42. In an illustrative embodiment, first tab controller 31 and rim 42 cooperate to form a monolithic element as suggested in FIG. 2.

Figure 3:
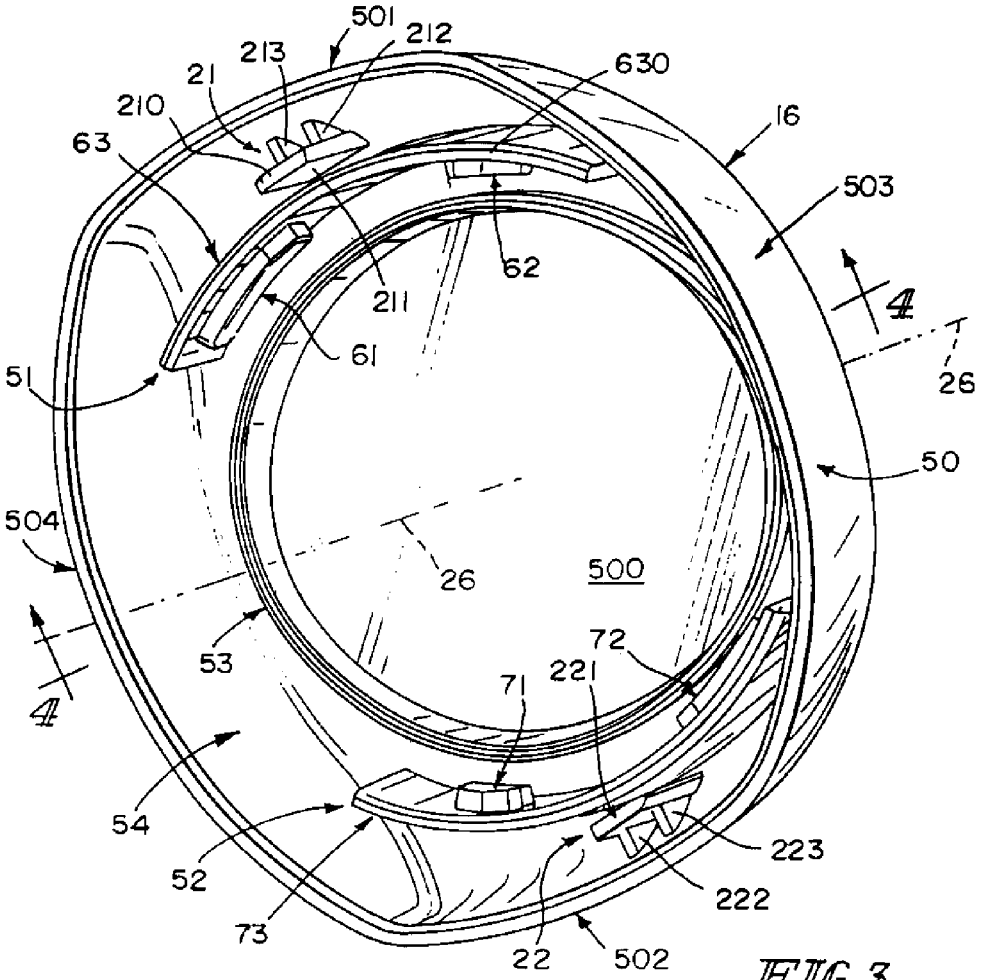
FIG. 3 is an enlarged perspective view of the underside of the closure of FIGS. 1 and 2 showing that the closure includes a lid comprising a top wall, two longer bowed side walls, and two shorter bowed tab-mover walls, a first child-resistant lock tab included in the closure-release control mechanism is coupled to the bowed tab-mover wall in the upper part of FIG. 3, and a second child-resistant lock tab included in the closure-release control mechanism is coupled to the bowed tab-mover wall in the lower part of FIG. 3 and showing that the closure further includes a curved first lid anchor located in close proximity to the first child-resistant lock tab and a curved second lid anchor located in close proximity to the second child-resistant lock tab and spaced-apart relation to the curved first lid anchor.
Figure 4:
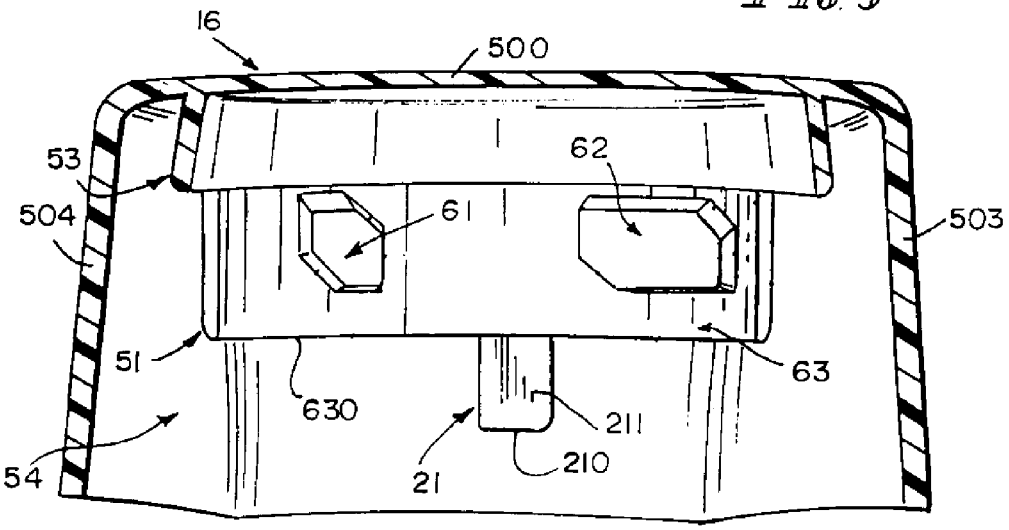
FIG. 4 is an enlarged sectional view taken along line 4-4 of FIG. 3 showing that the curved first lid anchor includes a short first anchor lug and a longer second anchor lug coupled to a curved lug support and showing a portion of the first lock tab extending downwardly below a lower edge of the curved lug support.

Closure 16 includes a lid 50, a first lid anchor 51, a second lid anchor 52, and a ring-shaped orientation member 53 as shown, for example, in FIGS. 2-4. First lock tab 21 is coupled to lid 50 and arranged to lie in an interior region 54 formed in lid 50 as suggested in FIGS. 2-4. First lid anchor 51 is configured to mate with companion closure retainer 44 during installation of closure 16 on container 12 as suggested in FIG. 2 and FIGS. 5-7 to retain lid 50 in a mounted position on filler neck 40 closing open mouth 18 of container 12. Second lid anchor 52 is configured to mate with another closure retainer 144 provided on filler neck 40 as suggested in FIG. 2. Closure retainer 144 is similar to closure retainer 44 in an illustrative embodiment.

Lid 50 includes a top wall 500 and first and second tab-mover walls 501, 502 coupled to top wall 500 and arranged to lie in spaced-apart relation to one another as shown in FIGS. 2, 3, and 8. Lid 50 also includes two side walls 503, 504 coupled to top wall 500 and to first and second tab-mover walls 501, 502. Side walls 503, 504 are arranged to lie in spaced-apart relation to one another as suggested in FIGS. 2, 3, and 8. In the illustrated embodiment, each of side walls 503, 504 is bowed and each of tab-mover walls 501, 502 is relatively shorter in length than each of the two side walls 503, 504.

First lock tab 21 is coupled to an interior surface of first tab-mover wall 501 as shown, for example, in FIG. 3. First lock tab 21 lies in interior region 54 of lid 50 and is not visible to an observer when closure 16 is mounted on container 12 as shown in FIG. 1.

First lock tab 21 includes a downwardly extending plate 211 cantilevered to first tab-mover wall 501 and a pair of plate buttresses 212, 213 coupled to plate 211 and to wall 501 and arranged to lie in spaced-apart relation to one another as shown, for example, in FIG. 3. Plate 211 of first lock tab 21 is arranged to extend into lock-tab receiver channel 24 and mate with stationary tab blocker 28 and tab-motion limiter strip 29 when closure 16 is mounted on container 12 as shown best in FIGS. 1, 7, and 8.

A second lock tab 22 is coupled to closure 16 in an illustrative embodiment as shown best in FIG. 3. Second lock tab 22 is coupled to an interior surface of second tab-mover wall 502, arranged to lie in interior region 54 of lid 50, and configured to be the mirror image of first lock tab 21 as suggested in FIG. 3.

Second lock tab 22 includes a plate 221 similar to plate 211 of first lock tab 21 as shown in FIGS. 2 and 8-10. Second lock tab 22 mates and interacts with a second tab controller 32 coupled to filler neck 40 of container 12 as suggested in FIGS. 2 and 8 in the same way that first lock tab 22 mates and interacts with first tab controller 31. Second lock tab 22 also includes two plate buttresses 222, 223 as shown in FIG. 3.

Second tab controller 32 includes a stationary tab blocker 128 and a tab-motion limiter strip 129 as shown in FIGS. 8-10. Second tab controller 32 includes a tab-blocker support platform 133 that is formed to include a lock-tab receiver channel 124 sized to receive plate 221 and second lock tab 22 as suggested in FIGS. 8 and 9. In the illustrated embodiment, second lock tab 22 and second tab controller 32 are included in child-resistant closure-release control mechanism 20 as suggested in FIGS. 8-10 and function in a manner suggested in FIGS. 8-10 to control release of closure 16 from companion container 12.

A first lid anchor 51 is included in closure 16 and configured to provide means for mating with closure retainer 44 coupled to filler neck 40 as suggested in FIG. 2 to retain closure 16 in an installed position on container 12 in a manner suggested in FIGS. 5-7. In an illustrative embodiment, a similar second lid anchor 52 is included in closure 16 and configured to mate with closure retainer 144 in a similar fashion. It is within the scope of the present disclosure to use any suitable lid anchor means to retain closure 16 in an installed position on container 12.

First lid anchor 51 illustratively includes a first anchor lug 61, a second anchor lug 62, and a lug support 63 coupled to lid 50 as suggested in FIGS. 2-4. Lug support 63 is established by a curved wall anchored to interior surface 500 of lid 50 and arranged to lie in a space provided between first lock tab 21 and ring-shaped orientation member 53 as shown best in FIG. 3. First anchor lug 61 is short in length and second anchor lug 62 is relatively longer than lug 61 in the illustrated embodiment. Each of lugs 61, 62 is arranged to extend from lug support 63 in radially inward directions toward axis of rotation 26 as suggested in FIGS. 2 and 3. Plate 211 of first lock tab 21 is arranged to extend downwardly below a lower edge 630 of lug support 63 as shown, for example, in FIG. 4.

Second lid anchor 52 illustratively includes a first anchor lug 71, a second anchor lug 72, and a lug support 73 coupled to lid 50 and to lugs 71, 72 as shown, for example, in FIG. 3. Second lid anchor 52 lies in a space provided between second lock tab 22 and ring-shaped orientation member 53. First anchor lug 71 is similar in shape and function to first anchor lug 61. Second anchor lug 72 is similar in shape and function to second anchor lug 62. Lug support 73 is similar in shape and function to lug support 63. Plate 221 of second lock tab 22 is arranged to extend downwardly below a lower edge 730 of lug support 73 as shown, for example, in FIG. 2.

Installation of closure 16 on container 12 is shown, for example, in FIGS. 2 and 5-7. During such installation, plate 211 of first lock tab 21 is moved into lock-tab receiver channel 24 as suggested in FIGS. 4, 5, and 6 and is aligned with stationary tab blocker 28 and tab-motion limiter strip 29 as suggested in FIG. 7. Tab-motion limiter strip 29 provides means for limiting radially outward motion of first lock tab 21 away from axis 26 when closure 16 is mounted on container 12. Similarly, during such closure installation, plate 221 of second lock tab 22 is moved into lock-tab receiver channel 124 and aligned with stationary tab blocker 128 and tab-motion limiter strip 129 as suggested in FIG. 8.

First lock tab 21 is moved downwardly toward stationary tab blocker 28 coupled to a horizontal tab-blocker support platform 33 included in closure-release control mechanism 20 as closure 16 is rotated in a clockwise direction 25 about a vertical axis of rotation 26 toward an installed position on container 12 is shown, for example, in FIG. 5. Further downward movement of first lock tab 21 into lock-tab receiver channel 24 formed in tab-blocker support platform coupled to container 12 is shown, for example, in FIG. 6. Deployment of first lock tab 21 in lock-tab receiver channel 24 to cause an end wall of first lock tab 21 to mate with a stop face 282 included in the tab blocker 28 and a relatively longer outer side wall of first lock tab 21 to mate with tab-motion limiter strip 29 included in tab-blocker support platform 33 and configured to provide means for blocking movement of first lock tab 21 in a radially outward direction away from the axis of rotation 26 of closure 16 while closure 16 is installed on container 12 and first lock tab 21 is arranged to lie in confronting relation to stop face 282 included in the tab blocker 28.

Removal of closure 16 from container 12 is shown, for example, in FIGS. 8-10. During such removal, plate 111 of first lock tab 21 is moved in lock-tab receiver channel 24 to disengage stationary tab blocker 28 and tab-motion limiter strip 29 as suggested in FIG. 9. Similarly, plate 221 of second lock tab 22 is moved in lock-tab receiver channel 124 to disengage stationary tab blocker 128 and tab-motion limiter strip 129 as also suggested in FIG. 9. Now closure 16 is free to rotate in a counterclockwise closure-removal direction 36 to separate closure 16 from container 12 as suggested in FIG. 10.

Mating engagement of an outer side wall of each of the first and second lock tabs 21, 22 coupled to the closure with a companion tab-motion limiter strip 29, 129 included in a tab-blocker support platform 33 or 133 coupled to container 12 to block readily outward movement of lock tabs 21, 22 away from axis of rotation 26 of closure 16 while closure 16 is mounted in an installed position on container 12 is shown in FIG. 8. A user is applying squeezing forces (represented by opposing arrows 34) to the two bowed tab-mover walls 501, 502 included in lid 50 to move each of first and second lock tabs 21, 22 radially inwardly to cause each of those lock tabs 21, 22 to separate from a companion tab-motion limiter strip 29, 129 and a stop 282 of a companion triangle-shaped tab-motion blocker 28, 128 to free closure 16 so it can be rotated in a counterclockwise closure-removal direction 36 relative to container 12 as shown in FIG. 9. Counterclockwise rotation of closure 16 relative to container 12 in closure-removal direction 36 is shown in FIG. 10.

A child-resistant canister 10 in accordance with the present disclosure includes container 12, closure 16, and closure-release control mechanism 20 as suggested in FIG. 2. Container 12 is formed to include a product-receiving chamber 14 and a mouth 18 opening into product-receiving chamber 14. Closure-release control mechanism 20 comprises a first lock tab 21 coupled to closure 16 and a first tab controller 31 coupled to container 12 and formed to include a lock-tab receiver channel 24 arranged to receive first lock tab 16 therein when closure 16 is mounted on container 12 to assume a closed position as suggested in FIGS. 2, 7, and 8.

First tab controller 31 includes tab blocker 28 and tab-motion limiter 29 as suggested in FIGS. 2, 5, and 8. Tab blocker 28 is configured normally to mate with first lock tab 21 upon movement of first lock tab 21 to a closure-retaining position in lock-tab receiver channel 24 as suggested in FIGS. 7 and 8 to block rotation of closure 16 relative to container 12 about axis of rotation 26 in a closure-removal direction 36 to retain closure 16 in the closed position on container 12 as shown in FIGS. 7 and 8. Tab-motion limiter 29 is configured to provide means for blocking movement of first lock tab 21 in a radially outward direction 30 away from axis of rotation 26 to unmate from tab blocker 28 during an unauthorized attempt to remove closure 16 from container 12 so that an unauthorized user is unable to move first lock tab 21 from the closure-retaining position shown in FIGS. 7 and 8 in radially outward direction 30 to assume a radially outwardly displaced position unmated from tab blocker 28 (and located outside of lock-tab receiver channel 24 and inside interior region 54 of lid 50) and then rotate closure 16 relative to container 12 about axis of rotation 26 in closure-removal direction 36 while first lock tab 21 remains in the radially outwardly displaced position to cause first lock tab 21 to move relative to and past tab blocker 28 without mating with tab blocker 28 in an unauthorized effort to remove closure 16 from container 12.

Container 12 includes a body 38 formed to include product-receiving chamber 14 and a filler neck 40 coupled to body 38 and formed to include mouth 18 as shown in FIG. 2. First tab controller 31 is coupled to filler neck 40 as also shown in FIG. 2. Tab-motion limiter 29 is arranged to lie in spaced-apart relation to filler neck 40 to locate first lock tab 21 in a section of lock-tab receiver channel 24 provided between filler neck 40 and tab-motion limiter 29 when closure 16 is mounted on container 12 to assume the closed position and first lock tab 21 is located in the closure-retaining position as suggested in FIGS. 7 and 8.

First tab controller 31 further includes first and second limiter supports 311, 312 as suggested in FIGS. 2, 6, and 8-10. First limiter support 311 is coupled to filler neck 40 and to tab-motion limiter 29. Second limiter support 312 is coupled to filler neck 40 and to tab-motion limiter 29 to support tab-motion limiter 29 in a stationary position relative to filler neck 40. Second limiter support 312 is arranged to lie in spaced-apart relation to first limiter support 311 to locate lock-tab receiver channel 24 therebetween as shown, for example, in FIG. 2.

Tab blocker 28 is coupled to tab-motion limiter 29 as suggested in FIGS. 2, 5, and 10. Tab blocker 78 is arranged to lie between tab-motion limiter 29 and filler neck 40 and between first and second limiter supports 311, 312 as shown best in FIGS. 2 and 10.

Tab-motion limiter 29 and first and second limiter supports 311, 132 cooperate to form a tab-blocker support platform 33 coupled to filler neck 40 as suggested in FIGS. 2, 5, and 8. Tab blocker 28 is coupled to tab-blocker support platform 33 to lie in a stationary position relative to filler neck 40 and to tab-motion limiter 29 and define an outer boundary of the lock-tab receiver channel 24. In an illustrative embodiment, outer boundary of lock-tab receiver channel 24 is defined by, in sequence, portions of filler neck 40, first limiter support 311, tab-motion limiter 29, tab blocker 28, and second limiter support 312 as shown, for example, in FIGS. 2 and 10.

Closure 16 includes a deformable lid 50 formed to include an interior region 54 as suggested in FIGS. 2 and 3. First lock tab 21 is coupled to deformable lid 50 and arranged to lie in interior region 54 as shown in FIGS. 2 and 3. First lock tab 21 is arranged to move in lock-tab receiver channel 24 from the closure-retaining position shown in FIG. 7 in a radially inward direction 130 toward axis of rotation 26 and away from tab-motion limiter 29 as suggested in FIG. 9 during inward deformation of deformable lid 50 to assume a radially inwardly displaced closure-releasing position (shown in FIG. 9) in lock-tab receiver channel 24 closer to axis of rotation 26. This inward movement is in response to application of an external force 34 to an exterior portion of deformable lid 50 associated with first lock tab 21 as suggested in FIG. 9 and causes separation of first lock tab 21 from tab blocker 28 to initiate removal of closure 16 from container 12. Such separation frees closure 16 to rotate relative to container 12 about axis of rotation 26 in closure-removal direction 36 in an authorized effort to remove closure 16 from container 12 as suggested in FIG. 10.

Filler neck 40 of container 12 includes a rim 42 and a closure retainer 44 as shown, for example, in FIG. 2. Rim 42 is coupled to body 38 and a passageway 118 communicating with mouth 18 and product-receiving chamber 14 as shown in FIG. 2. Closure retainer 44 is coupled to an exterior surface 43 of rim 42 to lie outside passageway 118 and configured to mate with closure 16 to retain closure 16 in the closed position on container 12 as suggested in FIGS. 1 and 8.

Deformable lid 50 includes a top wall 500 arranged to cover mouth 18 and a first tab-mover wall 501 coupled to first lock tab 21 as shown, for example, in FIG. 3. First tab-mover wall 501 is arranged to depend from top wall 500 to locate first lock tab 21 and closure-release control mechanism 20 in a space provided between first tab-mover wall 501 and rim 42 when closure 16 lies in the closed position as suggested in FIGS. 7 and 8. Tab-motion limiter 29 is arranged to lie in a space provided between first tab-mover wall 501 and first lock tab 21 when closure 16 lies in the closed position as suggested in FIGS. 7 and 8.

Tab-motion limiter 29 includes an exterior surface 291 that is arranged to face away from rim 42 and first tab-mover wall 501 is arranged to move toward and mate with exterior surface 291 of tab-motion limiter 29 during movement of first lock tab 21 in radially inward direction 130 from the closure-retaining position to the radially inwardly displaced closure-releasing position as suggested in FIG. 9.

Tab-motion limiter 29 further includes an interior surface 292 that is arranged to face toward rim 42 as suggested in FIG. 10. Tab blocker 28 is coupled to interior surface 292 of tab-motion limiter 29 and arranged to lie in a space provided between tab-motion limiter 29 and rim 42.

First tab controller 31 is coupled to exterior surface 43 of rim 42 and positioned to lie below closure retainer 44 on rim 42 and above top wall 46 of body 38 of container 12. First tab controller 31 is made of a rigid material and arranged to lie in a stationary position relative to rim 42 of filler neck 40 and body 38 of container 12 during movement of first lock tab 21 in lock-tab receiver channel 24 between the closure-retaining position shown in FIG. 8 and the radially inwardly displaced closure-releasing position shown in FIG. 9.

First lock tab 21 includes a plate 211 coupled to first-tab mover wall 50 as shown, for example, in FIG. 3. Plate 211 is arranged to extend downwardly into lock-tab receiver channel 24 and mate with tab blocker 28 and tab-motion limiter 29 when closure 16 is mounted in the closed position on container 12 and first lock tab 21 lies in the closure-retaining position as suggested in FIG. 7.

Tab blocker 28 includes a cam ramp 281 arranged to face away from tab-motion limiter 29 and toward rim 42 as shown in FIGS. 8-10. Tab blocker 28 is configured to provide means for contacting plate 211 as plate 211 moves downwardly into lock-tab receiver channel 24 and for yieldably biasing plate 211 in radially inward direction 130 toward rim 42 during rotation of closure 16 about axis of rotation 26 relative to container 12 in a closure-installation direction until plate 211 clears tab blocker 28 to cause plate 211 to move in an opposite radially outward direction 30 toward tab-motion limiter 29 to assume a locked position in which a first edge of plate 211 lies in closely confronting relation to a stop face 282 included in tab blocker 28 and a second edge of plate 211 lies in closely confronting relation to interior surface 292 of tab-motion limiter 29 that is arranged to face toward rim 42 and lie adjacent to stop face 282 of tab blocker 28.

First tab controller 31 includes a tab-blocker support platform 33 coupled to container 12 and formed to include lock-tab receiver channel 24. Tab blocker 28 is coupled to tab-blocker support platform 33 to lie in a stationary position relative to container 12 and provide a portion of an outer boundary of lock-tab receiver channel 24. Tab-blocker support platform 33 is formed to include tab-motion limiter 29 as suggested in FIG. 2.

First tab controller 31 further includes a first limiter support 311 coupled to container 12 and to tab-motion limiter 29 and a second limiter support 312 coupled to container 12 and to tab-motion limiter 29 to support tab-motion limiter 29 in a stationary position relative to container 12. Second limiter support 312 is arranged to lie in spaced-apart relation to first limiter support 311 to locate lock-tab receiver channel 24 therebetween as suggested in FIGS. 2 and 8. Tab blocker 28 is coupled to tab-motion limiter 29 and arranged to lie between tab motion limiter 29 and container 12 and between first and second limiter supports 311, 312.

Closure retainer 44 comprises a series of rail sections coupled to exterior surface 43 of filler neck 40 and configured to form a first anchor-retainer notch 441 and a separate second anchor-retainer notch 442 on exterior surface 43 of filler neck 40 as suggested in FIG. 2. Closure 12 further includes a first lid anchor 51 configured to mate with closure retainer 44 during installation of closure 16 on container 12 to retain lid 50 in a mounted position on filler neck 40 closing open mouth 18 of container 12.

First lid anchor 51 includes a lug support 63 and a first and second lug anchors 61, 62 as shown, for example, in FIGS. 2-4. Lug support 63 is coupled to lid 50 and arranged to lie in interior region 54 of lid 50. First lug anchor 61 is coupled to lug support 63 and arranged to extend toward axis of rotation 26 and into first anchor-retainer notch 441 when closure 116 lies in the closed position on container 12. Second lug anchor 62 is coupled to lug support 63 and arranged to extend toward axis of rotation 26 and into second anchor-retainer notch 442 when closure 16 lies in the closed position on container 12.

Lug support 63 is curved and has a concave surface facing toward axis of rotation 26 and a convex surface facing toward first lock tab 21 as suggested in FIG. 3. Lug support 63 is arranged to lie between first lock tab 21 and axis of rotation 26.

First lock tab 21 terminates at a lower edge 210 as shown, for example, in FIGS. 3 and 4. Lug support 63 terminates at a lower edge 630. Lower edge 630 of lug support 63 is arranged to lie between top wall 500 of lid 50 and lower edge 210 of first lock tab 21 as shown, for example, in FIG. 4.

Closure 16 further includes a ring-shaped orientation member 53 coupled to the top wall 500 of lid 50 as shown, for example, in FIGS. 2 and 3. Ring-shaped orientation member 53 is arranged to lie in interior region 54 of lid 50 to mate with rim 42 when closure 16 lies in the closed position on container 12 to orient lid 50 in a predetermined aligned relation with container 12. Lug support 63 is arranged to lie between first lock tab 21 and ring-shaped orientation ring 53 as suggested in FIG. 3.

Figure 11:
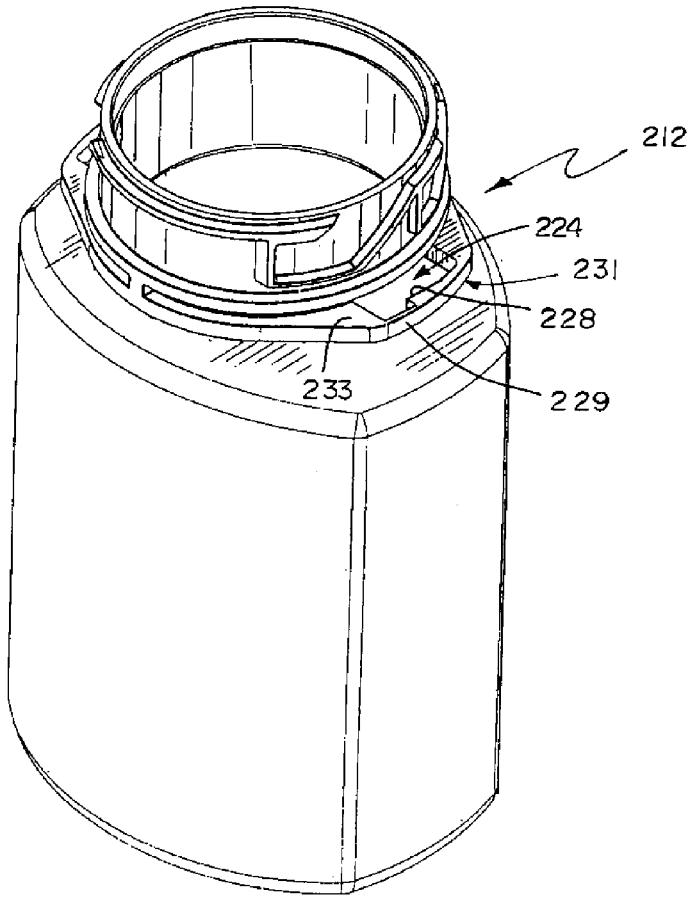
FIG. 11 is a perspective view of a container in accordance with a second embodiment of the present disclosure showing formation of a lock-tab receiver channel in a horizontal platform coupled to the container and provision of a low-profile tab blocker in that lock-tab receiver channel.

As suggested in FIG. 11, a container 212 in accordance with a second embodiment of the present disclosure includes a low-profile tab blocker 228. Tab controller 231 includes a horizontal tab-support platform 233 formed to include a lock-tab receiver channel 224 and a tab-motion limiter strip 229. Low-profile tab blocker 228 is coupled to tab-support platform 233. Closure 16 mounts on container 212 in substantially the same manner as it mounts on container 12.

The invention claimed is:

1. A child-resistant canister comprising a container formed to include a product-receiving chamber and a mouth opening into the product-receiving chamber, a closure including a lid comprising a wall formed to include an interior region and configured to mount on the container to assume a closed position closing the mouth formed in the container when rotated relative to the container about an axis of rotation, and a closure-release control mechanism comprising a first lock tab spaced radially inwardly of the lid wall and coupled to the lid of the closure and arranged to lie in the interior region formed in the lid and a first tab controller coupled to the container and formed to include a lock-tab receiver channel arranged to receive the first lock tab therein when the closure is mounted on the container to assume the closed position, wherein the first tab controller includes a tab blocker configured normally to mate with the first lock tab upon movement of the first lock tab to a closure-retaining position in the lock-tab receiver channel to block rotation of the closure relative to the container about the axis of rotation in a closure-removal direction to retain the closure in the closed position on the container and a tab-motion limiter configured to provide means for blocking movement of the first lock tab in a radially outward direction away from the axis of rotation to unmate from the tab blocker during an unauthorized attempt to remove the closure from the container so that an unauthorized user is unable to move the first lock tab from the closure-retaining position in a radially outward direction to assume a radially outwardly displaced position unmated from the tab blocker and then rotate the closure relative to the container about the axis of rotation in a closure-removal direction while the first lock tab remains in the radially outwardly displaced position to cause the first lock tab to move relative to and past the tab blocker without mating with the tab blocker in an unauthorized effort to remove the closure from the container.

2. The canister of claim 1, wherein the container includes a body formed to include the product-receiving chamber and a filler neck coupled to the body and formed to include the mouth, the first tab controller is coupled to the filler neck, and the tab-motion limiter is arranged to lie in spaced-apart relation to the filler neck to locate the first lock tab in a section of the lock-tab receiver channel provided between the filler neck and the tab-motion limiter when the closure is mounted on the container to assume the closed position and the first lock tab is located in the closure-retaining position.

3. A child-resistant canister comprising a container formed to include a product-receiving chamber and a mouth opening into the product-receiving chamber, a closure configured to mount on the container to assume a closed position closing the mouth formed in the container when rotated relative to the container about an axis of rotation, and a closure-release control mechanism comprising a first lock tab coupled to the closure and a first tab controller coupled to the container and formed to include a lock-tab receiver channel arranged to receive the first lock tab therein when the closure is mounted on the container to assume the closed position, wherein the first tab controller includes a tab blocker configured normally to mate with the first lock tab upon movement of the first lock tab to a closure-retaining position in the lock-tab receiver channel to block rotation of the closure relative to the container about the axis of rotation in a closure-removal direction to retain the closure in the closed position on the container and a tab-motion limiter configured to provide means for blocking movement of the first lock tab in a radially outward direction away from the axis of rotation to unmate from the tab blocker during an unauthorized attempt to remove the closure from the container so that an unauthorized user is unable to move the first lock tab from the closure-retaining position in a radially outward direction to assume a radially outwardly displaced position unmated from the tab blocker and then rotate the closure relative to the container about the axis of rotation in a closure-removal direction while the first lock tab remains in the radially outwardly displaced position to cause the first lock tab to move relative to and past the tab blocker without mating with the tab blocker in an unauthorized effort to remove the closure from the container wherein the container includes a body formed to include the product-receiving chamber and a filler neck coupled to the body and formed to include the mouth, the first tab controller further includes a first limiter support coupled to the filler neck and to the tab-motion limiter and a second limiter support coupled to the filler neck and to the tab-motion limiter to support the tab-motion limiter in a stationary position relative to the filler neck and the second limiter support is arranged to lie in spaced-apart relation to the first limiter support to locate the lock-tab receiver channel therebetween and wherein the first limiter support and second limiter support are arranged to lie above and in spaced-apart relation to the body.

4. The canister of claim 3, wherein the tab blocker is coupled to the tab-motion limiter and arranged to lie between the tab-motion limiter and the filler neck and between the first and second limiter supports.

5. A child-resistant canister comprising a container formed to include a product-receiving chamber and a mouth opening into the product-receiving chamber, a closure configured to mount on the container to assume a closed position closing the mouth formed in the container when rotated relative to the container about an axis of rotation, and a closure-release control mechanism comprising a first lock tab coupled to the closure and a first tab controller coupled to the container and formed to include a lock-tab receiver channel arranged to receive the first lock tab therein when the closure is mounted on the container to assume the closed position, wherein the first tab controller includes a tab blocker configured normally to mate with the first lock tab upon movement of the first lock tab to a closure-retaining position in the lock-tab receiver channel to block rotation of the closure relative to the container about the axis of rotation in a closure-removal direction to retain the closure in the closed position on the container and a tab-motion limiter configured to provide means for blocking movement of the first lock tab in a radially outward direction away from the axis of rotation to unmate from the tab blocker during an unauthorized attempt to remove the closure from the container so that an unauthorized user is unable to move the first lock tab from the closure-retaining position in a radially outward direction to assume a radially outwardly displaced position unmated from the tab blocker and then rotate the closure relative to the container about the axis of rotation in a closure-removal direction while the first lock tab remains in the radially outwardly displaced position to cause the first lock tab to move relative to and past the tab blocker without mating with the tab blocker in an unauthorized effort to remove the closure from the container wherein the container includes a body formed to include the product-receiving chamber and a filler neck coupled to the body and formed to include the mouth, the tab-motion limiter and the first and second limiter supports cooperate to form a tab-blocker support platform coupled to the filler neck and arranged to lie above and in spaced-apart relation to the body to locate the tab blocker support platform above and in spaced-apart relation to the body and the tab blocker is coupled to the tab-blocker support platform to lie in a stationary position relative to the filler neck and to the tab-motion limiter and define an outer boundary of the lock-tab receiver channel.

6. The canister of claim 3, wherein an outer boundary of the lock-tab receiver channel is defined by portions of the filler neck, first limiter support, tab-motion limiter, tab blocker, and second limiter support.

7. A child-resistant canister comprising a container formed to include a product-receiving chamber and a mouth opening into the product-receiving chamber, a closure configured to mount on the container to assume a closed position closing the mouth formed in the container when rotated relative to the container about an axis of rotation, and a closure-release control mechanism comprising a first lock tab coupled to the closure and a first tab controller coupled to the container and formed to include a lock-tab receiver channel arranged to receive the first lock tab therein when the closure is mounted on the container to assume the closed position, wherein the first tab controller includes a tab blocker configured normally to mate with the first lock tab upon movement of the first lock tab to a closure-retaining position in the lock-tab receiver channel to block rotation of the closure relative to the container about the axis of rotation in a closure-removal direction to retain the closure in the closed position on the container and a tab-motion limiter configured to provide means for blocking movement of the first lock tab in a radially outward direction away from the axis of rotation to unmate from the tab blocker during an unauthorized attempt to remove the closure from the container so that an unauthorized user is unable to move the first lock tab from the closure-retaining position in a radially outward direction to assume a radially outwardly displaced position unmated from the tab blocker and then rotate the closure relative to the container about the axis of rotation in a closure-removal direction while the first lock tab remains in the radially outwardly displaced position to cause the first lock tab to move relative to and past the tab blocker without mating with the tab blocker in an unauthorized effort to remove the closure from the container, and wherein the closure includes a deformable lid formed to include an interior region, the first lock tab is coupled to the deformable lid and arranged to lie in the interior region, and the first lock tab is arranged to move in the lock-tab receiver channel from the closure-retaining position in a radially inward direction toward the axis of rotation and away from the tab-motion limiter during inward deformation of the deformable lid to assume a radially inwardly displaced closure-releasing position in the lock-tab receiver channel closer to the axis of rotation in response to application of an external force to an exterior portion of the deformable lid associated with the first lock tab to separate the first lock tab from the tab blocker to initiate removal of the closure from the container and free the closure to rotate relative to the container about the axis of rotation in the closure-removal direction in an authorized effort to remove the closure from the container.

8. A child-resistant canister comprising a container formed to include a product-receiving chamber and a mouth opening into the product-receiving chamber, a closure configured to mount on the container to assume a closed position closing the mouth formed in the container when rotated relative to the container about an axis of rotation, and a closure-release control mechanism comprising a first lock tab coupled to the closure and a first tab controller coupled to the container and formed to include a lock-tab receiver channel arranged to receive the first lock tab therein when the closure is mounted on the container to assume the closed position, wherein the first tab controller includes a tab blocker configured normally to mate with the first lock tab upon movement of the first lock tab to a closure-retaining position in the lock-tab receiver channel to block rotation of the closure relative to the container about the axis of rotation in a closure-removal direction to retain the closure in the closed position on the container and a tab-motion limiter configured to provide means for blocking movement of the first lock tab in a radially outward direction away from the axis of rotation to unmate from the tab blocker during an unauthorized attempt to remove the closure from the container so that an unauthorized user is unable to move the first lock tab from the closure-retaining position in a radially outward direction to assume a radially outwardly displaced position unmated from the tab blocker and then rotate the closure relative to the container about the axis of rotation in a closure-removal direction while the first lock tab remains in the radially outwardly displaced position to cause the first lock tab to move relative to and past the tab blocker without mating with the tab blocker in an unauthorized effort to remove the closure from the container, wherein the closure includes a deformable lid formed to include an interior region, the first lock tab is coupled to the deformable lid and arranged to lie in the interior region, and the first lock tab is arranged to move in the lock-tab receiver channel from the closure-retaining position in a radially inward direction toward the axis of rotation and away from the tab-motion limiter during inward deformation of the deformable lid to assume a radially inwardly displaced closure-releasing position in the lock-tab receiver channel closer to the axis of rotation in response to application of an external force to an exterior portion of the deformable lid associated with the first lock tab to separate the first lock tab from the tab blocker to initiate removal of the closure from the container and free the closure to rotate relative to the container about the axis of rotation in the closure-removal direction in an authorized effort to remove the closure from the container, and wherein the container includes a body formed to include the product-receiving chamber and a filler neck coupled to the body and formed to include the mouth, the filler neck includes a rim coupled to the body and formed to include a passageway communicating with the mouth and the product-receiving chamber and a closure retainer coupled to an exterior surface of the rim to lie outside the passageway and configured to mate with the closure to retain the closure in the closed position on the container, the deformable lid includes a top wall arranged to cover the mouth and a first tab-mover wall coupled to the first lock tab and arranged to depend from the top wall to locate the first lock tab and the closure-release control mechanism in a space provided between the first tab-mover wall and the rim when the closure lies in the closed position, and the tab-motion limiter is arranged to lie in a space provided between the first tab-mover wall and the first lock tab when the closure lies in the closed position.

9. The canister of claim 8, wherein the tab-motion limiter includes an exterior surface that is arranged to face away from the rim and the first tab-mover wall is arranged to move toward and mate with the exterior wall of the tab-motion limiter during movement of the first lock tab from the closure-retaining position to the radially inwardly displaced closure-releasing position.

10. The canister of claim 9, wherein the tab-motion limiter further includes an interior surface that is arranged to face toward the rim and the tab blocker is coupled to the interior surface of the tab-motion limiter and arranged to lie in a space provided between the tab-motion limiter and the rim.

11. The canister of claim 8, wherein the first tab controller is coupled to the exterior surface of the rim and positioned to lie below the closure retainer on the rim and above a top wall of the body of the container.

12. The canister of claim 11, wherein the first tab controller is made of a rigid material and arranged to lie in a stationary position relative to the rim of the filler neck and the body of the container during movement of the first lock tab in the lock-tab receiver channel between the closure-retaining position and the radially inwardly displaced closure-releasing position.

13. The canister of claim 8, wherein the first lock tab includes a plate coupled to the first-tab mover wall and arranged to extend downwardly into the lock-tab receiver channel and mate with the tab blocker and the tab-motion limiter when the closure is mounted in the closed position on the container and the first lock tab lies in the closure-retaining position.

14. The canister of claim 13, wherein the tab blocker includes a cam ramp arranged to face away from the tab-motion limiter and toward the rim and is configured to provide means for contacting the plate as the plate moves downwardly into the lock-tab receiver channel and for yieldably biasing the plate in a radially inward direction toward the rim during rotation of the closure about the axis of rotation relative to the container in a closure-installation direction until the plate clears the tab blocker to cause the plate to move in an opposite radially outward direction toward the tab-motion limiter to assume a locked position in which a first edge of the plate lies in closely confronting relation to a stop face included in the tab blocker and a second edge of the plate lies in closely confronting relation to an interior surface of the tab-motion limiter that is arranged to face toward the rim and lie adjacent to the stop face of the tab blocker.

15. The canister of claim 1, wherein the first tab controller includes a tab-blocker support platform coupled to the container and formed to include the lock-tab receiver channel, the tab blocker is coupled to the tab-blocker support platform to lie in a stationary position relative to the container and provide a portion of an outer boundary of the lock-tab-receiver channel, and the tab-blocker support platform is formed to include the tab-motion limiter.

16. The canister of claim 15, wherein the first tab controller further includes a first limiter support coupled to the container and to the tab-motion limiter and a second limiter support coupled to the container and to the tab-motion limiter to support the tab-motion limiter in a stationary position relative to the container, the second limiter support is arranged to lie in spaced-apart relation to the first limiter support to locate the lock-tab receiver channel therebetween, and the tab blocker is coupled to the tab-motion limiter and arranged to lie between the tab-motion limiter and the container and between the first and second limiter supports.

17. A child-resistant canister comprising a container formed to include a product-receiving chamber and a mouth opening into the product-receiving chamber, a closure configured to mount on the container to assume a closed position closing the mouth formed in the container when rotated relative to the container about an axis of rotation, and a closure-release control mechanism comprising a first lock tab coupled to the closure and a first tab controller coupled to the container and formed to include a lock-tab receiver channel arranged to receive the first lock tab therein when the closure is mounted on the container to assume the closed position, wherein the first tab controller includes a tab blocker configured normally to mate with the first lock tab upon movement of the first lock tab to a closure-retaining position in the lock-tab receiver channel to block rotation of the closure relative to the container about the axis of rotation in a closure-removal direction to retain the closure in the closed position on the container and a tab-motion limiter configured to provide means for blocking movement of the first lock tab in a radially outward direction away from the axis of rotation to unmate from the tab blocker during an unauthorized attempt to remove the closure from the container so that an unauthorized user is unable to move the first lock tab from the closure-retaining position in a radially outward direction to assume a radially outwardly displaced position unmated from the tab blocker and then rotate the closure relative to the container about the axis of rotation in a closure-removal direction while the first lock tab remains in the radially outwardly displaced position to cause the first lock tab to move relative to and past the tab blocker without mating with the tab blocker in an unauthorized effort to remove the closure from the container, and wherein the closure includes a deformable lid formed to include an interior region, the first lock tab is coupled to the deformable lid and arranged to lie in the interior region, the container includes a body formed to include the product-receiving chamber and a filler neck coupled to the body and formed to include the mouth, the filler neck includes a rim coupled to the body and formed to include a passageway communicating with the mouth and the product-receiving chamber and a closure retainer coupled to an exterior surface of the rim to lie outside the passageway and configured to mate with the closure to retain the closure in the closed position on the container, the deformable lid includes a top wall arranged to cover the mouth and a first tab-mover wall coupled to the first lock tab and arranged to depend from the top wall to locate the first lock tab and the closure-release control mechanism in a space provided between the first tab-mover wall and the rim when the closure lies in the closed position, and the tab-motion limiter is arranged to lie in a space provided between the first tab-mover wall and the first lock tab when the closure lies in the closed position.

18. The canister of claim 17, wherein the closure retainer comprises a series of rail sections coupled to the exterior surface of the filler neck and configured to form a first anchor-retainer notch and a separate second anchor-retainer notch on the exterior surface of the filler neck, the closure further includes a first lid anchor configured to mate with the closure retainer during installation of the closure on the container to retain the lid in a mounted position on the filler neck closing the open mouth of the container, the first lid anchor includes a lug support coupled to the lid and arranged to lie in the interior region of the lid, a first lug anchor coupled to the lug support and arranged to extend toward the axis of rotation and into the first anchor-retainer notch when the closure lies in the closed position on the container and a second lug anchor coupled to the lug support and arranged to extend toward the axis of rotation and into the second anchor-retainer notch when the closure lies in the closed position on the container.

19. The canister of claim 18, wherein the lug support is curved and has a concave surface facing toward the axis of rotation and a convex surface facing toward the first lock tab.

20. The canister of claim 18, wherein the lug support is arranged to lie between the first lock tab and the axis of rotation.

21. The canister of claim 18, wherein the first lock tab terminates at a lower edge, the lug support terminates at a lower edge, and the lower edge of the lug support is arranged to lie between the top wall of the lid and the lower edge of the first lock tab.

22. The canister of claim 18, wherein the closure further includes a ring-shaped orientation member coupled to the top wall of the lid and arranged to lie in the interior region of the lid to mate with the rim when the closure lies in the closed position on the container to orient the lid in a predetermined aligned relation with the container and the lug support is arranged to lie between the first lock tab and the ring-shaped orientation ring.

23. A child-resistant canister comprising a container comprising a body and a filler neck, a closure configured to rotate about an axis of rotation relative to the container to mount on the container to close an opening into an interior region formed in the container, the closure including a lid and a lid anchor coupled to the lid and arranged to mate with a closure retainer included in the container to retain the closure in a mounted position on the container, a closure-release control mechanism includes a first lock tab coupled to the lid and a first tab controller coupled to the container and configured to mate with the first lock tab normally to block rotation of the lid relative to the container about the axis of rotation while the closure lies in the mounted position on the container and to block radially outward movement of the first lock tab away from the axis of rotation when the closure lies in the mounted position on the container to minimize a chance of unauthorized removal of the closure from the container by blocking movement of the first lock tab in a radially outward direction away from the axis of rotation, and wherein the first tab controller is mounted on the filler neck and is spaced from the body, the first tab controller being configured to have a portion located radially outward of the first lock tab to block radially outward movement of the first lock tab.

24. The canister of claim 23, wherein the first tab controller is formed to include a lock-tab receiver channel sized and located to receive the first lock tab therein when the closure is mounted on the container and the first tab controller includes a rigid tab blocker located in a stationary position relative to the container to mate with the first lock tab normally to block rotation of the lid relative to the container about the axis of rotation when the closure lies in the closed position on the container and a tab-motion limiter strip coupled to the tab-blocker and arranged to lie in spaced-apart relation to the container to form a portion of the lock-tab receiver channel therebetween and to lie in spaced-apart relation to the axis of rotation to locate the first lock tab therebetween when the closure lies in the mounted position on the container so as to retain the first lock tab in closely confronting relation to the tab blocker.

* * * * *